United States Patent [19]

Radtke

[11] Patent Number: 4,478,297

[45] Date of Patent: Oct. 23, 1984

[54] DRILL BIT HAVING CUTTING ELEMENTS WITH HEAT REMOVAL CORES

[75] Inventor: Robert P. Radtke, Kingwood, Tex.

[73] Assignee: Strata Bit Corporation, Houston, Tex.

[21] Appl. No.: 430,988

[22] Filed: Sep. 30, 1982

[51] Int. Cl.[3] ..... E21B 10/46

[52] U.S. Cl. ..... 175/329; 175/410

[58] Field of Search ..... 175/329, 410, 327; 407/120, 118, 119, 32, 11

[56] References Cited

U.S. PATENT DOCUMENTS

| | | | |
|---|---|---|---|
| 1,522,593 | 1/1925 | Pickin | 175/410 |
| 4,073,354 | 2/1978 | Rowley et al. | 175/329 |
| 4,098,363 | 7/1978 | Rohde et al. | 175/329 |
| 4,156,329 | 5/1979 | Daniels et al. | 51/295 |
| 4,323,130 | 4/1982 | Dennis | 175/410 X |

FOREIGN PATENT DOCUMENTS

| | | | |
|---|---|---|---|
| 0632497 | 11/1978 | U.S.S.R. | 407/120 |

OTHER PUBLICATIONS

Chapter entitled "Stratapax Bits", pp. 541-591, published in Advanced Drilling Techniques, by Wm. C. Maurer, The Petroleum Publishing Company, Oklahoma, published 1980.

*Primary Examiner*—James A. Leppink
*Assistant Examiner*—Michael Starinsky
*Attorney, Agent, or Firm*—Burns, Doane, Swecker & Mathis

[57] ABSTRACT

A drill bit for connection on a drill string has a hollow tubular body with an end cutting face and an exterior peripheral stabilizer surface with cylindrical sintered carbide inserts positioned therein having polycrystalline diamond cutting elements mounted on said inserts. Said inserts each having a longitudinal recess therein filled with a soft, heat conducting metal operable to facilitate the transfer of heat away from said cutting elements. The drill bit is also provided with removable and replacable nozzles.

4 Claims, 15 Drawing Figures

FIG. 2
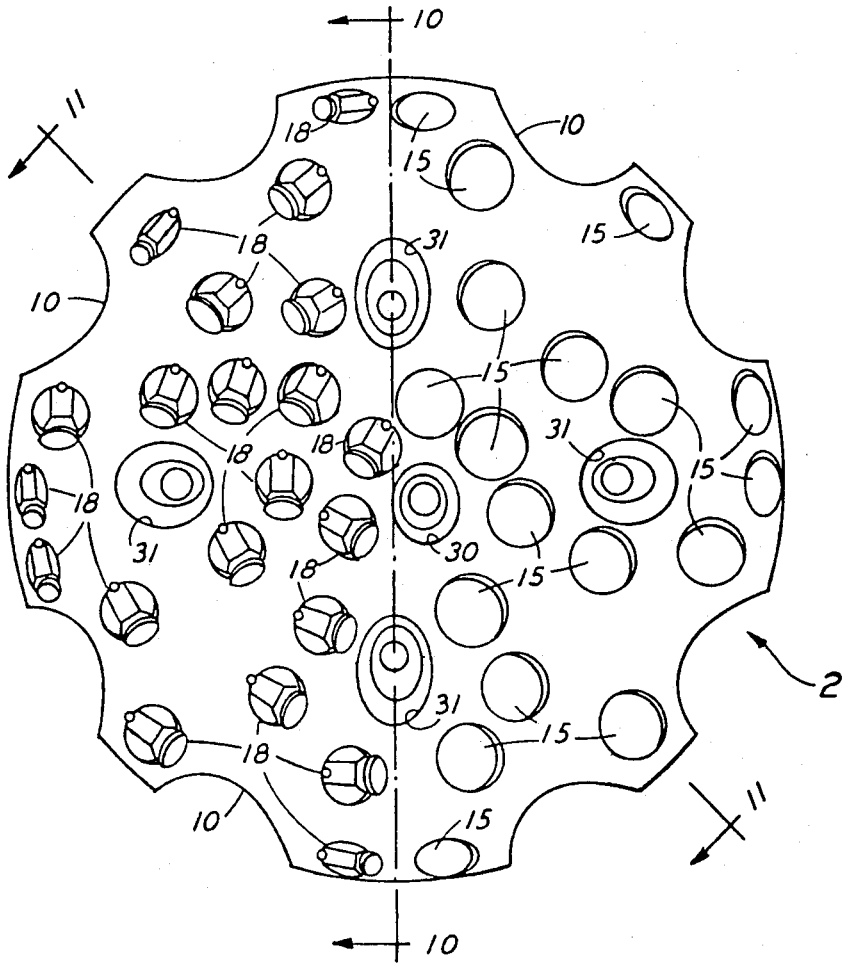
FIG. 5
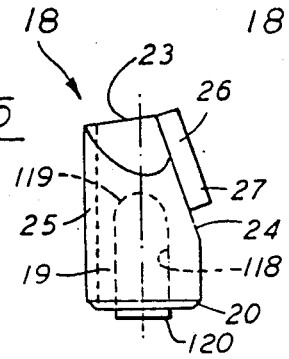
FIG. 6
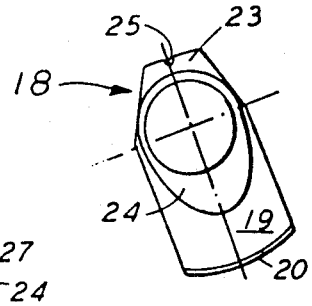
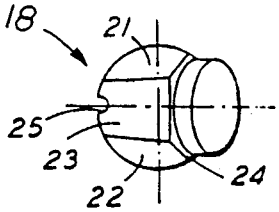
FIG. 7

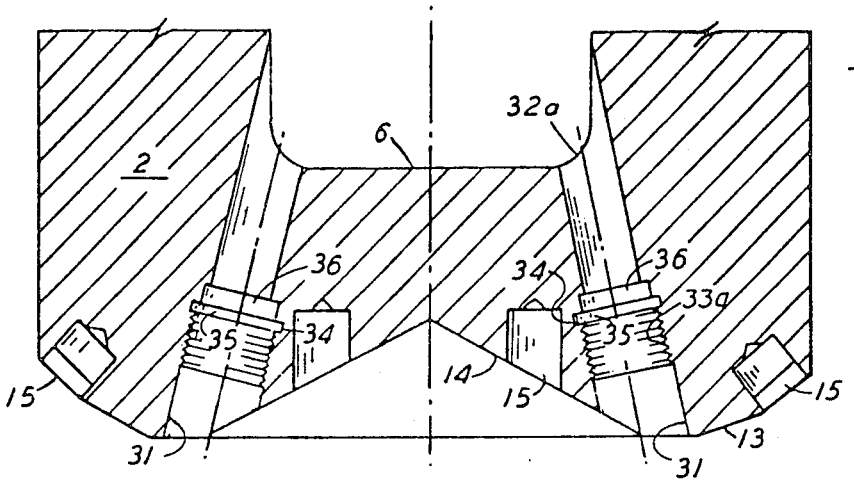
FIG. 10
FIG. 11
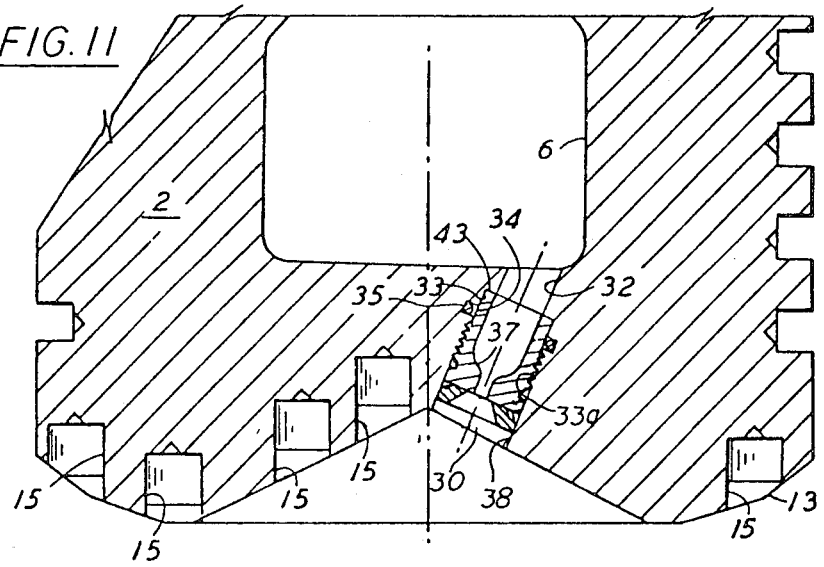
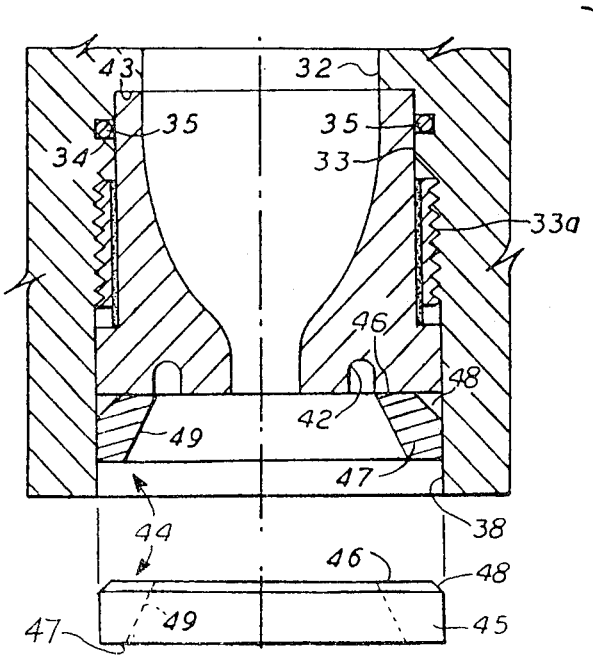
FIG. 12

DRILL BIT HAVING CUTTING ELEMENTS WITH HEAT REMOVAL CORES

BACKGROUND OF THE INVENTION

1. Field of the Invention

This invention relates to new and useful improvements in drill bits and more particularly to drill bits having diamond cutting elements and means for protecting the same from excessive heat during cutting operation.

2. Brief Description of the Prior Art

Rotary drill bits used in earth drilling are primarily of two major types. One major type of drill bit is the roller cone bit having three legs depending from a bit body which support three roller cones carrying tungsten carbide teeth for cutting rock and other earth formations. Another major type of rotary drill bit is the diamond bit which has fixed teeth of industrial diamonds supported on the drill body or on metallic or carbide studs or slugs anchored in the drill body.

There are several types of diamond bits known to the drilling industry. In one type, the diamonds are a very small size and randomly distributed in a supporting matrix. Another type contains diamonds of a larger size positioned on the surface of a drill shank in a predetermined pattern. Still another type involves the use of a cutter formed of a polycrystalline diamond supported on a sintered carbide support.

Some of the most recent publications dealing with diamond bits of advanced design, relavent to this invention, consists of Rowley, et al. U.S. Pat. No. 4,073,354 and Rohde, et al. U.S. Pat. No. 4,098,363. An example of cutting inserts using polycrystalline diamond cutters and an illustration of a drill bit using such cutters, is found in Daniels, et al. U.S. Pat. No. 4,156,329.

The most comprehensive treatment of this subject in the literature is probably the chapter entitled STRATAPAX bits, pages 541–591 in ADVANCED DRILLING TECHNIQUES, by William C. Maurer, The Petroleum Publishing Company, 1421 South Sheridan Road, P.O. Box 1260, Tulsa, Okla., 74101, published in 1980. This reference illustrates and discusses in detail the development of the STRATAPAX diamond cutting elements by General Electric and gives several examples of commercial drill bits and prototypes using such cutting elements.

These patents and the cited literature show the construction of various diamond bits and related prior art but do not consider the problem of heat transfer away from the diamond cutting elements.

SUMMARY OF THE INVENTION

One of the objects of this invention is to provide a new and improved drill bit having diamond insert cutters with improved heat conducting means.

Another object is to provide a drill bit having carbide inserts with a novel heat conducting means for removing heat from the diamond cutting elements.

Another object is to provide an improved drill bit having carbide inserts with diamond cutting elements supported thereon and having integral heat conductors for removing heat from the cutting elements.

Still another object is to provide an improved drill bit with carbide inserts with diamond cutting elements thereon, the carbide inserts being hollow and filled with a neat conducting metal.

Other objects and features of this invention will become apparent from time to time throughout the specification and claims as hereinafter related.

The foregoing objectives are accomplished by a new and improved drill bit as described herein. A drill bit for connection on a drill string has a hollow tubular body with an end cutting face and an exterior peripheral stabilizer surface with cylindrical sintered carbide inserts positioned therein having polycrystalline diamond cutting elements mounted on said inserts. Said inserts each having a longitudinal recess therein filled with a soft, heat conducting metal operable to facilitate the transfer of heat awy from said cutting elements. The drill bit is also provided with removable and replacable nozzles.

BRIEF DESCRIPTION OF THE DRAWINGS

FIG. 2 is a plan view of the bottom of the drill bit shown in FIG. 1 showing half of the bit with cutting inserts in place and half without the inserts, showing only the recesses, and also showing the nozzle retaining rings in place.

FIG. 5 is a view in side elevation of one of the cutting inserts with heat conducting material therein.

FIG. 6 is a view of one of the cutting inserts in plan relative to the surface on which the cutting element is mounted.

FIG. 7 is a top view of the cutting insert shown in FIG. 5.

FIG. 10 is a view in section taken on the line 10—10 of FIG. 2.

FIG. 11 is a sectional view taken on the line 11—11 of FIG. 2.

FIG. 12 is a detail, enlarged sectional view of the removable and replaceable nozzle member shown in FIGS. 1 and 11 with the retaining ring shown in a partially exploded relation.

DESCRIPTION OF THE PREFERRED EMBODIMENTS

In the following description, unless otherwise noted, the general description of the drill bit is that of the applicant's prior applications, viz. Ser. Nos. 220,306, filed Dec. 29, 1980 now abandoned, 158,389 issued Apr. 6, 1982 as U.S. Pat. Nos. 4,323,130, 296,811 issued May 3, 1983 as U.S. Pat. Nos. 4,381,825, 303,721 issued Aug.

2, 1983 as U.S. Pat. Nos. 4,396,077, and 303,960 issued Apr. 14, 1984 as U.S. Pat. No. 4,442,909.

Figure 1:
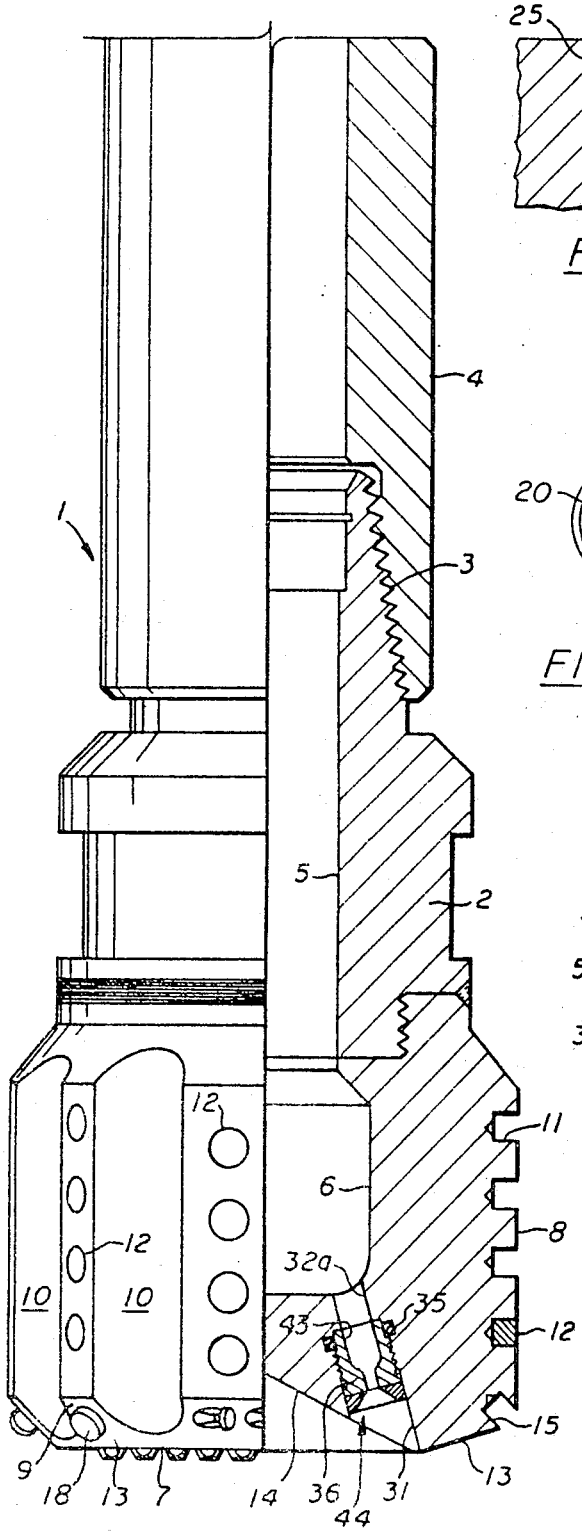
FIG. 1 is a view partly in elevation and partly in quarter section of an earth boring drill bit with diamond-containing cutting inserts incorporating a preferred embodiment of this invention and showing the threaded replaceable nozzle and nozzle retaining ring.

Referring to the drawings by numerals of reference and more particularly to FIG. 1, there is shown a drill bit 1 having replaceable drilling nozzles held in place by a threaded arrangement comprising a preferred embodiment of this invention. The threaded arrangement for securing nozzles may be used in other types of drill bits but is particularly useful in this bit because of the close proximity of the nozzles to the cutting surface of the bit and the bottom of the drill hole which results in a very high rate of wear.

The particular drill bit shown includes many features found in a drill bit described in afore-mentioned Dennis U.S. Pat. No. 4,323,130 and applicant's abandoned application Ser. No. 220,306, filed Dec. 29, 1980 (which discloses an improved arrangement for securing replaceable nozzles in drilling bits by means of a metal or hard metal retaining ring).

Drill bit 1 comprises a tubular body 2 which is adapted to be connected as by a threaded connection 3 to a drill collar 4 in a conventional drill string. The body 2 of drill bit 1 has a longitudinally extending passage 5 terminating in a cavity 6 formed by end wall 7 which is the cutting face of the drill bit.

Drill bit 1 has a peripheral stabilizer surface 8 which meets the cutting face 7 at the gage cutting edge portion 9. The stabilizer portion 8 is provided with a plurality of grooves or courses 10 which provide for flow of drilling mud or other drilling fluid around the bit during drilling operation. The stabilizer surface 8 is provided with a plurality of cylindrical holes or recesses 11 in which are positioned hard metal inserts 12. The hard metal inserts 12 are preferably of a sintered carbide and are cylindrical in shape and held in place in recesses 11 by an interference fit with the flat end of the insert being substantially flush with the stabilizer surface 8.

Figure 3:
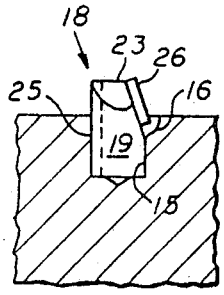
FIG. 3 is a sectional view taken normal to the surface of the drill bit through one of the recesses in which the cutting inserts are positioned and showing the insert in elevation.
Figure 4:
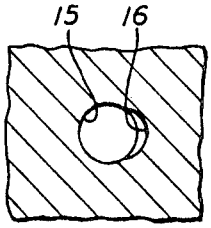
FIG. 4 is a sectional view in plan showing the hole or recess in which the cutting insert is positioned.

The cutting surface or cutting face 7 of the drill bit body 2 is preferably a crown surface defined by the intersection of outer conical surface 13 and inner negative conical surface 14. The crown surfaces 13 and 14 are provided with a plurality of sockets or recesses 15 spaced therearound in a selected pattern. As will be seen from the bottom plan view in FIG. 2, the sockets or recesses 15 and the cutting inserts which are positioned therein are arranged in substantially a spiral pattern. In FIGS. 3 and 4, the sockets or recesses 15 are shown in more detail with the cutting inserts being illustrated.

Each of the recesses 15 is provided with a counterbore 16 extending for only part of the depth of the recess 15. There is also provided a smaller diameter cylindrical recess 17 which intersects the wall of recess 15 and is open thereto. Recess 17 functions to receive a retaining pin as will be subsequently described. The recesses 15 in crown faces 13 and 14 receive a plurality of cutting elements 18 which are seen in FIGS. 1 and 2 and are shown in substantial detail in FIGS. 3, 5, 6 and 7.

Cutting elements 18 are preferably STRATAPAX cutters manufactured by General Electric Company and described in Daniels, et al. U.S. Pat. No. 4,156,329, Rowley, et al. U.S. Pat. No. 4,073,354 and in considerable detail in ADVANCED DRILLING TECHNIQUES by William C. Maurer. The STRATAPAX cutting elements 18 consist of a cylindrical supporting stud 19 of sintered carbide. Stud 19 is beveled at the bottom as indicated at 20, has edge tapered surfaces 21 and 22, a top tapered surface 23 and an angularly oriented supporting surface 24.

Figure 5A:
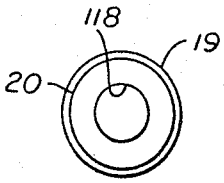
FIG. 5A is a bottom view of the cutting insert of FIG. 5 showing the recess for the heat conducting material.
Figure 5B:
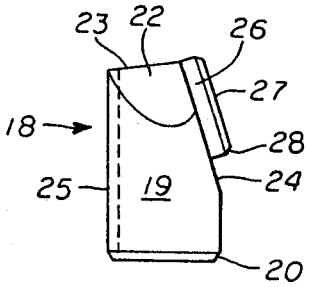
FIG. 5B is a view in side elevation of an alternate embodiment of one of the cutting inserts.

A small cylindrical groove 25 is provided along one side of supporting stud 19. A disc shaped cutting element 26 is bonded on angular supporting surface 24, preferably by brazing or the like. Disc shaped cutting element 26 is a sintered carbide disc having a cutting surface 27 comprising polycrystalline diamond. In FIG. 5B, there is shown an alternate form of cutting element 18 in which the cutting surface 27 of polycrystalline diamond on disc shaped cutter 26 is beveled around the peripheral edge as indicated at 28.

In extensive commercial use, it has been found that excessive heat build up on the diamond cutting elements during drilling is one of the major causes of cutting element failure. The supporting stud 19 is made of sintered tungsten carbide which is a very poor conductor of heat. The diamond cutting elements 26 carry all of the frictional load in drilling and are quickly heated to a very high temperature. As a result, there has been a need for better heat transfer away from the cutting elements.

In the preferred embodiment of this invention, the carbide studs 19 are hollow, being provided with longitudinally extending recesses 118 which terminate in a spherically curved end 119. The recesses 118 are filled with plugs 120 which fill the recess and extend slightly outside the end, as seen in FIG. 5. The plugs are made of a soft, heat conducting metal which makes intimate contact with the bottom of cutter insert recesses 15 and functions to conduct heat from the diamond cutting elements into the bit body 2. Suitable metals include copper, silver, aluminum, sodium, soft iron, etc. The bit body 2 acts as a massive heat sink for removing heat from the diamond cutting elements 26 and transfers the heat to the drilling fluid which carries it away. The plug extends slightly beyond the end of the stud prior to assembly and is spread over the bottom of the recess in which the stud is positioned during assembly and is intimately in contact with the bit body for maximum heat transfer.

The relative size of supporting studs 19 of cutting elements 18 and the diameter of recesses 15 are selected so that cutting elements 18 will have a tight interference fit in the recesses 15. The recesses 15 are oriented so that when the cutting elements are properly positioned therein the disc shaped diamond faced cutters 26 will be positioned with the cutting surfaces facing the direction of rotation of the drill bit. When the cutting elements 18 are properly positioned in sockets or recesses 15 the groove 25 in supporting stud 19 is aligned with the small half cylindrical recess 17 on the edge of socket or recess 15.

Half cylindrical recess 17 and cylindrical groove 25 in supporting stud 19 together form a cylindrical cavity in which there is positioned a retaining pin 29. Retaining pin 29 is a metal pin of sufficient size that it is retained in the cavity between the groove 25 and recess 17 by an interference fit. This further assists in holding cutting element 18 tightly in the cutting face of the drill bit and prevents rotation or twisting of the cutting element during cutting operation.

In FIG. 3, the retaining pin 29 is shown as a relatively short pin terminating flush with the surface of the cutting face in which the cutting element is imbedded. The recess 17 in which pin 29 is inserted is shown as extending only about half the depth of recess 15. This is one preferred arrangement although recess 17 can be extended for the entire depth of recess 15 if desired or the use of the retaining pin can be eliminated and the interference fit alone used to secure the supporting stud 19 in place and against rotation.

Drill bit body 2 is provided with a centrally located nozzle passage 30 and a plurality of equally spaced nozzle passages 31 toward the outer part of the bit body. The nozzle passages 30 and 31 are designed to provide for the flow of drilling fluid, i.e. drilling mud or the like, to keep the bit clear of rock particles and debris as it is operated.

The outer nozzle passages 31 are preferably positioned in an outward angle of about 10°–25° relative to the longitudinal axis of the bit body. The central nozzle passage 30 is preferably set at an angle of about 30° relative to the longitudinal axis of the bit body. The outward angle of nozzle passages 31 directs the flow of drilling fluid toward the outside of the bore hole and preferably ejects the drilling fluid at about the peak surface of the crown surface on which the cutting inserts are mounted.

This arrangement of nozzle passages and nozzles provides a superior cleaning action for removal of rock particles and debris from the cutting area when the drill bit is being operated. The proximity of the nozzles to the cutting curface, however, causes a problem of excessive wear which has been difficult to overcome. The erosive effect of rock particles at the cutting surface tends to erode the lower end surface of the bit body and also tends to erode the metal surrounding the nozzle passages. In the past, snap rings have usually been used to hold nozzles in place and these are eroded rapidly during drilling with annoying losses of nozzles in the hole.

The central nozzle passage 30 comprises passage 32 extending from drill body cavity 6 and has a counterbore 33 cut therein providing a shoulder 43. Counterbore 33 is provided with a peripheral groove 34 in which there is positioned an O-ring 35. Counterbore 33 is internally threaded as indicated at **33*a* and opens into an enlarged smooth bore portion 38** which opens through the lower end portion or face of the drill bit body.

A nozzle member 36 is threadedly secured in counterbore 33 against shoulder 43 and has a passage 37 providing a nozzle for discharge of drilling fluid. Nozzle member 36 is a removable and interchangeable member which may be removed for servicing or replacement or for interchange with a nozzle of a different size or shape, as desired.

Nozzle member 36 has its main portion formed of a hard metal, e.g. carbide or the like, with a smooth cylindrical exterior 38 and an end flange 39. Since hard metal is substantially unmachinable, it is virtually impossible to form threads in the nozzle member. A steel (or other suitable metal) sleeve 40 is brazed (or otherwise secured) to cylindrical nozzle portion 38 as indicated at 50 and has male threads 51 sized to be threadedly secured in the female threaded portion **33*a* of nozzle counterbore 33**.

Figure 8:
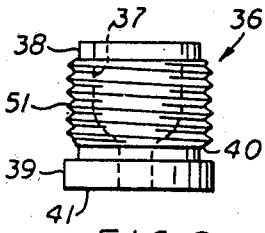
FIG. 8 is a view in elevation of one of the replaceable nozzle members.
Figure 9:
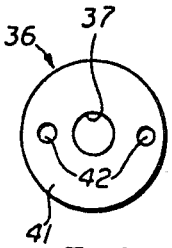
FIG. 9 is an end view of the nozzle member shown in FIGS. 8 and 8A.
Figure 8A:
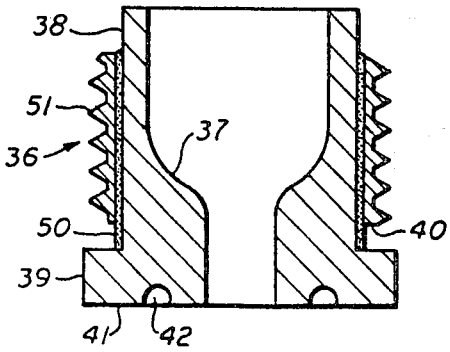
FIG. 8A is a view in central section, slightly enlarged, of the nozzle member shown in FIG. 8.

As seen in FIGS. 8, 8A and 9, the end face 41 of nozzle member 36 has recesses or indentations 42 formed therein which provide for insertion of a suitable wrench or tool forturning the nozzle member 36 to screw or unscrew the same for installation or removal. The peripheral surface of nozzle flange 39 fits the enlarged bore 38 of the nozzle-containing passage so that the nozzle member 36 can be threadedly installed in the position shown, with its end abutting shoulder 43. The face 41 of flange 39 shields the metal of threads 51 from abrasive wear or erosion.

The threaded arrangement for securing nozzle members 36 in place avoids the problem encountered when snap rings are used for retention, viz. erosive wear and breakage of the snap rings with loss of nozzles in the bottom of the boreholes. There is a further problem, however, with the threaded connection in that the nozzle may become unscrewed during use and lost in the hole.

This problem can be overcome by use of locking type screw threads but such an arrangement has the disadvantage of making removal and replacement of the nozzles more difficult. Another arrangement for solving this problem is for the apparatus to be provided with a retaining ring 44 which protects the nozzle member 36 and the enlarged bore portion 38 against wear and prevents the nozzles from unscrewing and becoming lost downhole.

In FIG. 10, the nozzle passages 31 are shown in some detail with the nozzle member 36 in place but without the retaining ring 44. In the nozzle passages 31, each nozzle passage **32*a* opens from body cavity 6 and is intersected by counterbore 33*a*. In FIG. 10, nozzle member 36 is shown unsectioned so that only the exterior cylindrical surface is seen. O-ring 35 is seen in full elevation surrounding the cylindrical surface 38 of nozzle member 36 and extending into peripheral groove 34**.

There is a considerable advantage to the use of nozzle members threadedly secured as shown in FIGS. 10–12 and particularly extending at the angles described. In FIGS. 11 and 12, the retaining rings 44 are shown in more detail. These rings are press fitted in place and secure the nozzle members 36 against loss by unscrewing. Rings 44 also provide protection to the end of the nozzle members and to the metal of the bit body surrounding the enlarged bore portion 38. In FIG. 12, nozzle member 36 is shown positioned in place against shoulder 43 with the O-ring 35 providing the desired seal against leakage. In this view, retaining ring 44 is shown both in place and in exploded relation.

Retaining ring 44 is an annular ring having a cylindrical outer surface 45 and flat end surfaces 46 and 47. A peripheral bevel 48 is provided at the intersection of outer surface 45 and end face 46. The inner opening 49 is of adequate size to permit unobstructed flow of drilling fluid from nozzle passage 37. Opening 49 may be cylindrical or any other desired configuration, but is preferably a conical surface, as shown, flaring outward toward the end of passage 31 opening through the cutting face 7 of bit body 2. Retaining ring 44 has its outer surface 45 very slightly larger than the inner surface or bore of passage 31 and has an interference fit therein. The bevel 48 on retaining ring 44 permits the ring to be pressed into the slightly smaller bore of passage 31 without cutting or scoring the bit body. The retaining ring 44 is preferably oversize by about 0.002–0.004 inch in relation to the bore of passage 31.

Retaining ring 44 is preferably of a hardened steel or a hard metal, such as sintered tungsten carbide. Retaining rings 44 may be used in the retention of all of the nozzle members 36 against unscrewing. Retaining rings 44 hold nozzle members 36 tightly in place to prevent unscrewing and to protect against erosion or wear during use. Retaining rings 44 can be drilled out or removed by suitably designed tools for exchange or replacement of the nozzle members 36 in the field.

OPERATION

The operation of this drill bit should be apparent from the foregoing description of its component parts and method of assembly. Nevertheless, it is useful to restate the operating characteristics of this novel drill bit to make its novel features and advantages clear and understandable.

The drill bit as shown in the drawings and described above is primarily a rotary bit of the type having fixed diamond surfaced cutting inserts. Most of the features described relate only to the construction of a diamond bit. The use of retaining rings 44 and the threaded, replaceable nozzle members 36, as shown in FIGS. 1, 11, and 12, is of more general application.

This arrangement for retention of the removable and interchangeable nozzle members is useful in a diamond bit as described and shown herein but would also be of like use in providing for the retention of removable and interchangeable nozzle member in roller bits, particularly when equipped with extended nozzles, or any other bits which have a flow of drilling fluid through the bit body and out through a flow directing nozzle. The threaded arrangement for releasably securing the nozzle members in place is therefore considered to be of general application and not specifically restricted to the retention of nozzles in diamond cutter insert type bits.

In operation, this drill bit is rotated by a drill string through the connection by means of the drill collar 4 shown in FIG. 1. Diamond surfaced cutting elements 18 cut into the rock or other earth formations as the bit is rotated and the rock particles and other debris is continuously flushed by drilling fluid, e.g. drilling mud, which flows through the drill string and the interior passage 5 of the drill bit and is ejected through nozzle passages 30 and 31 as previously described.

The central nozzle 30 is set at an angle of about 30° to flush away cuttings and debris from the inside of the cutting crown. The outer nozzle passages 31 are set at an angle of 10°–25° outward relative to the longitudinal axis of the drill bit body. These nozzle passages emerge through the cutting face at about the peak of the crown cutting surface. This causes the drilling fluid to be ejected toward the edges of the bore hole and assists in flushing rock particles and cuttings and debris away from the cutting surface. As noted above in the description of contruction and assembly, the nozzle passages 30 and 31 are formed by removable nozzle members 36 which are held in place by threads 51 in sleeve 40 and secured against unscrewing by retaining rings 44 secured by an interference fit.

The peripheral surface or stabilizer surface 8 of drill bit body 2 is provided with a plurality of sintered carbide cylindrical inserts 12 positioned in sockets or recesses 11 thereof. These inserts protect stabilizer surface 8 against excessive wear and assist in keeping the bore hole to proper gage to prevent the drill bit from binding in the hole. The grooves or courses 10 in stabilizer surface 8 provide for circulation of drilling fluid, i.e. drilling mud, past the drill bit body 2 to remove rock cuttings and debris to the surface.

As previously pointed out, the construction and arrangement of the cutting elements and the method of assembly and retention of these elements is especially important to the operation of this drill bit. The drill bit is designed to cut through very hard rock and is subjected to very substantial stresses. Typical cutting elements 18 are STRATAPAX cutting elements manufactured by General Electric Company and consist of diamond surfaced cutting discs supported on carbide studs as described above. The counterbore 16 adjacent to the socket or recess 15 in which cutting element stud 19 is fitted allows for cutting disc 26 to be partially recessed below the surface of the cutting face of the drill bit and also provides for relieving the stress on the drill bit during the cutting operation.

The optional use of retaining pin 29, which is inserted into the cavity defined by passage 17 and groove 25 provides a further interference fit assisting in retaining cutting element 18 in position and protecting it against twisting movement during cutting operation of the drill bit. The arrangement of cutting elements 18 in a spiral pattern on the crown cutting surface, as shown in FIG. 2, provides for a uniform cutting action on the bottom of the bore hole. The cutters 18 which lie on the outer conical cutting surface 15 function to cut the gage of the bore hole and these cutters together with the carbide inserts 12 in the stabilizer surface 8 function to hold the side walls of the bore hole to proper gage and prevent binding of the drill bit in the bore hole.

The heat conducting plugs 120 in the carbide studs 19 draws heat away from the diamond cutting discs 26 and dissipates it with the assistance of the bit body 2 and the circulating drilling fluid. This improved cooling system is operable to lower the operating temperature of the diamond cutting discs substantially and improves the life of the drill bit.

While this invention has been described fully and completely with special emphasis upon a single preferred embodiment, it should be understood that within the scope of the appended claims the invention may be practiced otherwise than as specifically described herein.

I claim:

1. A drill bit comprising:

a drill bit body having a hollow tubular body adapted to be connected to a drill string, said drill bit body having an exterior peripheral stabilizer surface and an end cutting face, said end cutting face having a plurality of cylindrical recesses spaced therearound in a selected pattern, said recesses each having a bottom surface, a plurality of cutting elements, one for each of said recesses and positioned therein by an interference fit, said cutting elements each comprising a cylindrical supporting stud of sintered carbide having a cylindrical side wall and an angularly oriented supporting surface with a disc-shaped element bonded thereon comprising a sintered carbide disc having a cutting surface comprising polycrystalline diamond, and heat conducting means associated with said cutting elements and operable to conduct heat away from said disc-shaped elements during drilling operations, said heat conducting means each comprising a core of soft heat conductive metal disposed within said stud at a location spaced inwardly from said stud side wall, said core including a projecting portion projecting beyond an end of said stud located opposite said supporting surface and being spaced inwardly from said stud side wall, said core projecting portion being in intimate contact with said bottom surface of said recess to conduct heat directly into said bit body.

2. A drill bit according to claim 1, in which said metal core is copper, silver, aluminum, sodium, or soft iron.

3. A drill bit cutting element comprising:

a cylindrical supporting stud of sintered carbide having a cylindrical side wall and an angularly oriented supporting surface with a disc-shaped element bonded thereon comprising a sintered carbide disc having a cutting surface comprising polycrystalline diamond, and heat conducting means supported on said cutting element and operable to conduct heat away from said disc-shaped elements during use, said heat conducting means comprising a core of soft heat conductive metal disposed within said stud at a location spaced inwardly from said stud side wall, said core including a projecting portion projecting beyond an end of said stud located opposite said supporting surface and being spaced inwardly from said stud side wall.

4. A drill bit cutting element according to claim 3, in which said metal core is copper, silver, aluminum, sodium, or soft iron.

* * * * *